US011331521B2

(12) United States Patent
Werz

(10) Patent No.: US 11,331,521 B2
(45) Date of Patent: May 17, 2022

(54) BREATHING AID

(71) Applicant: ADVENATE GmbH, St. Johann (DE)

(72) Inventor: Matthias Werz, Engstingen (DE)

(73) Assignee: ADVENATE GmbH, St. Johann (DE)

( * ) Notice: Subject to any disclaimer, the term of this patent is extended or adjusted under 35 U.S.C. 154(b) by 418 days.

(21) Appl. No.: 16/342,727

(22) PCT Filed: Aug. 14, 2017

(86) PCT No.: PCT/EP2017/070623
§ 371 (c)(1),
(2) Date: Apr. 17, 2019

(87) PCT Pub. No.: WO2018/077506
PCT Pub. Date: May 3, 2018

(65) Prior Publication Data

US 2020/0222731 A1 Jul. 16, 2020

(30) Foreign Application Priority Data

Oct. 26, 2016 (DE) ..... 10 2016 120 441.2

(51) Int. Cl.
*A62B 33/00* (2006.01)
*A62B 9/06* (2006.01)
(Continued)

(52) U.S. Cl.
CPC ..... *A62B 33/00* (2013.01); *A62B 9/02* (2013.01); *A62B 9/06* (2013.01); *A62B 23/00* (2013.01)

(58) Field of Classification Search
CPC .. A62B 7/12; A62B 33/00; A62B 9/02; A62B 9/06; A62B 23/00
See application file for complete search history.

(56) References Cited

U.S. PATENT DOCUMENTS 2,385,938 A * 10/1945 Pierce ..... A62B 19/00
128/201.18
3,291,121 A * 12/1966 Vizneau ..... A61M 16/06
128/205.15

(Continued)

FOREIGN PATENT DOCUMENTS

AT 291006 B 6/1971
DE 202006009726 U1 8/2006

(Continued)

OTHER PUBLICATIONS

English translation for FR1443927, translated on espacenet.com, translated on Sep. 22, 2021.*

(Continued)

*Primary Examiner* — Tu A Vo
(74) *Attorney, Agent, or Firm* — Collard & Roe, P.C.

(57) ABSTRACT

A breathing aid for enabling a person buried by an avalanche to breathe has a housing which includes an inhalation channel having a valve situated in the housing, which automatically opens during inhalation and automatically closes during exhalation, and an exhalation channel having a valve situated in the housing, which automatically closes during inhalation and automatically opens during exhalation, wherein the inhalation channel and the exhalation channel open into a mouthpiece situated on the housing, and the housing includes at least one inhalation opening into which the inhalation channel opens, wherein the housing is designed as a handle which can be gripped by a user's hand and brought to the mouth.

17 Claims, 5 Drawing Sheets

(51) Int. Cl.
*A62B 23/00* (2006.01)
*A62B 9/02* (2006.01)

(56) References Cited

U.S. PATENT DOCUMENTS 4,079,735 A * 3/1978 Gaffney ..... A62B 9/06 128/204.18
4,354,628 A 10/1982 Green
4,365,628 A * 12/1982 Hodel ..... A62B 7/02 128/205.12
4,553,920 A 11/1985 Biadigo et al.
4,928,710 A * 5/1990 Campbell ..... A62B 9/06 128/200.29
4,996,982 A * 3/1991 Williamson ..... A62B 7/04 128/205.24
5,490,501 A * 2/1996 Crowley ..... A62B 33/00 128/200.24
5,749,358 A * 5/1998 Good ..... A61M 16/0078 128/202.28
6,158,380 A * 12/2000 Aschauer ..... A62B 33/00 116/210
6,807,964 B1 * 10/2004 Ruddy ..... A61M 16/1075 128/201.13
7,984,711 B2 7/2011 Schipper et al.
7,985,711 B2 7/2011 Schipper et al.
8,196,581 B2 6/2012 Bozanic et al.
9,833,645 B2 12/2017 Jones
10,092,783 B2 10/2018 Werz
2003/0085569 A1 * 5/2003 Nishio ..... F16L 47/041 285/331
2006/0005831 A1 * 1/2006 Stewart ..... B63C 9/1255 128/201.27
2006/0107952 A1 * 5/2006 Schlosser ..... A41D 13/018 128/202.19
2007/0012360 A1 * 1/2007 Flynn ..... A61M 16/208 137/102
2007/0056500 A1 * 3/2007 Beck ..... A62B 33/00 116/210
2007/0113853 A1 * 5/2007 Pavesi ..... A62B 9/003 128/205.25
2007/0119455 A1 * 5/2007 Schipper ..... A45F 3/04 128/205.22
2008/0257643 A1 * 10/2008 Weinel ..... A63B 29/021 182/18
2009/0163095 A1 * 6/2009 Weinel ..... A62B 33/00 441/114
2009/0239428 A1 * 9/2009 Berchten ..... A62B 33/00 441/80
2009/0260628 A1 * 10/2009 Flynn, Sr. ..... A61M 16/0078 128/203.28
2010/0184343 A1 * 7/2010 Paynton ..... A62B 33/00 441/90
2010/0229285 A1 * 9/2010 Kindermann ..... A42B 3/281 2/410
2012/0060267 A1 * 3/2012 Blenkarn ..... A62B 17/00 2/456
2013/0019994 A1 * 1/2013 Schaer ..... F17C 7/00 141/313
2013/0145528 A1 * 6/2013 Grutta ..... A62B 33/00 2/455
2013/0145529 A1 * 6/2013 Grutta ..... A62B 33/00 2/455
2013/0146175 A1 * 6/2013 Walker ..... A45F 3/04 141/4
2013/0149923 A1 * 6/2013 Walker ..... A62B 17/00 441/80
2013/0149924 A1 * 6/2013 Grutta ..... A62B 33/00 441/80
2013/0199520 A1 * 8/2013 Dhuper ..... A61M 16/0833 128/200.23
2015/0013680 A1 * 1/2015 Mayo ..... G06K 19/00 128/205.27
2015/0027446 A1 * 1/2015 Brega ..... A62B 33/00 128/206.16
2016/0015094 A1 * 1/2016 Walker ..... A62B 33/00 441/80
2016/0206924 A1 * 7/2016 Schaer ..... A62B 33/00
2016/0256661 A1 * 9/2016 Battersby ..... A61M 16/0078
2017/0050058 A1 * 2/2017 Konrad ..... A62B 23/02
2018/0001979 A1 1/2018 Ocklenburg et al.
2018/0064967 A1 * 3/2018 Brookes ..... A41D 13/11
2018/0296158 A1 * 10/2018 Fisher ..... A61B 5/083
2018/0326233 A1 11/2018 Staub et al.

FOREIGN PATENT DOCUMENTS

DE 102014111655 A1 2/2016
EP 0098639 A2 1/1984
EP 0998959 A1 * 5/2000 ..... A62B 33/00
EP 0998959 A1 5/2000
EP 1790386 A2 5/2007
EP 2620181 A1 7/2013
EP 3042586 A1 7/2016
FR 1443927 A 7/1966
FR 1443927 A * 7/1966 ..... A62B 33/00
GB 2437926 A 11/2007
WO 2013181080 A1 12/2013
WO 2016102522 A2 6/2016
WO 2017077074 A1 5/2017

OTHER PUBLICATIONS

International Search Report of PCT/EP2017/070623, dated Dec. 19, 2017.
German Office Action dated Jul. 25, 2017 (for DE 10 2016120 441.2) with English translation of relevant parts.
English Translation of International Preliminary Report on Patentability for PCT/EP2017/070623 dated Jul. 12, 2018.

* cited by examiner

BREATHING AID

CROSS REFERENCE TO RELATED APPLICATIONS

This application is the National Stage of PCT/EP2017/070623 filed on Aug. 14, 2017, which claims priority under 35 U.S.C. § 119 of German Application No. 10 2016 120 441.2 filed on Oct. 26, 2016, the disclosures of which are incorporated by reference. The international application under PCT article 21(2) was not published in English.

BACKGROUND OF THE INVENTION

The invention relates to a breathing aid for enabling a person buried by an avalanche to breathe, comprising a housing which includes an inhalation channel comprising a valve situated in the housing, which automatically opens during inhalation and automatically closes during exhalation, and an exhalation channel comprising a valve situated in the housing, which automatically closes during inhalation and automatically opens during exhalation, wherein the inhalation channel and the exhalation channel open into a mouthpiece situated on the housing.

The chances of survival for people in an avalanche depend on various factors. Approximately 25% of avalanche victims die due to trauma suffered during the avalanche. Approximately 75% of the victims due to asphyxiation (suffocation). Snow consists, in principle, of a large percentage of air, depending on the extent of compaction of the snow. The problem is not the lack of oxygen in an avalanche, but rather the re-inhalation of $CO_2$ that the buried persons have exhaled.

U.S. Pat. No. 4,365,628 and DE 10 2014 111 655 A1 describe systems which are operated by high-pressure oxygen cartridges. The disadvantage of these systems is that the cartridges, which must be carried along, have a certain amount of weight. Moreover, these systems do not make use of the air that is available in sufficient quantities in every avalanche, and they do not separate the life-threatening exhaled air. Avalanche rescue systems of this type also frequently do not comprise a mouthpiece, but rather a mask. This has the disadvantage that the user must hold the mask tight with his or her hand, which may not be possible or may be extremely difficult when the user has been buried by an avalanche. A user may possibly not hold the mask on the face long enough.

For example, it is known from EP 0 998 959 A1 to separate the inhaled air and the exhaled air. This takes place with the aid of a valve system which is mounted on the shoulder or in the hip area of a user. In the valve system, fresh air is drawn in from the snow pack, and inhaled air and exhaled air are separated. The inhaled air is drawn in, via a tube, in the direction of the mouthpiece. The exhaled air is carried away from the valve system via a further tube. A breathing tube of up to 60 cm in length is located between the mouthpiece of these rescue systems and the valve system. The volume of this breathing tube is referred to as dead space and is associated with a considerable disadvantage. All the air that is located in the tube up to the valves is inhaled once again. A user therefore inhales the life-threatening $CO_2$ once again and, therefore, is placed at risk of slow $CO_2$ poisoning.

WO 2016/102522 A2 describes a valve system for a breathing aid for swimmers, comprising a valve housing and a valve diaphragm situated in the housing; on a contact section preferably formed in a central area of the valve diaphragm, the valve diaphragm is situated on a first end of a fastening element, wherein, originating from the contact section, the valve diaphragm extends at least partially at an angle in the direction of a second end of the fastening element. The valve system is situated at a distance from a mouthpiece. In particular, the mouthpiece is connected to the valve system via a tube. The separation of inhaled air and exhaled air takes place in the valve system. Dead space is therefore present here as well, and so there is the risk that a user will re-inhale $CO_2$-containing air that he or she had previously exhaled.

GB 2 437 926 A describes a device which comprises a mouthpiece including an exhalation valve. An inhalation valve can be situated in a tube leading to a filter unit.

WO 2013/181080 A1 describes a device which comprises a mouthpiece including two valves. The inhalation valve communicates with a tube, on the end of which a filter is situated. The filter is situated in the area of a user's ear.

DE 20 2006 009 726 U1 describes a safety helmet for skiiers, which comprises a tube system including a mouthpiece and a breathing air intake area and a respiratory gas outlet area which is situated on the helmet at a distance from the intake area. The helmet comprises a mouthpiece, in the area of which an inhalation valve and an exhalation valve are situated. An inhalation channel communicates with openings on the outer side of the helmet.

U.S. Pat. No. 5,490,501 describes a breathing aid, wherein a channel originating from a mouthpiece branches, and a valve is situated in each of the channels. The mouthpiece can be attached to a vest.

FR 1,443,927 A describes a breathing aid comprising a housing, in which two valves are situated and which includes a mouthpiece.

WO 2017/077074 A1 describes an avalanche protection device comprising an avalanche protection backpack including at least one inflatable buoyant airbag. Moreover, a breathing system is provided, comprising a breathing housing which connects a one-way valve to an ambient-air intake zone, and connects an exhalation one-way valve to an exhalation tube and a $CO_2$ exhalation area, wherein a mouthpiece is provided on the breathing housing.

SUMMARY OF THE INVENTION

The problem addressed by the present invention is that of providing a breathing aid which is suitable for reliably protecting a person, who has been buried by an avalanche, from asphyxiation.

This problem is solved according to the invention by a breathing aid for enabling a person buried by an avalanche to breathe, comprising a housing which includes an inhalation channel comprising a valve situated in the housing, which automatically opens during inhalation and automatically closes during exhalation, and an exhalation channel comprising a valve situated in the housing, which automatically closes during inhalation and automatically opens during exhalation, wherein the inhalation channel and the exhalation channel open into a mouthpiece situated on the housing, and the housing includes at least one inhalation opening into which the inhalation channel opens, wherein the housing is designed as a handle which can be gripped by a user's hand and brought to the mouth.

Therefore, it is possible to carry the breathing aid along during winter sports activities, without the breathing aid being located in the area of the mouth during normal physical activity and, therefore, possibly bothering or hampering a winter sports enthusiast. Due to the fact that the housing is designed as a handle, the breathing aid can be brought to the mouth easily and quickly as necessary, namely in particular when the winter sports enthusiast has been buried by an avalanche. It is also possible to couple the housing to an avalanche rescue system, so that a release system can be activated by the movement of the breathing aid to the mouth, in order to thereby inflate an avalanche airbag, for example, which is located inside a backpack. In the same movement, the user therefore brings the release handle, which is designed as a breathing aid, to the mouth.

The separation of the exhaled air and the inhaled air takes place with the aid of the valves directly in the housing, i.e., in the proximity of the mouthpiece. Due to the fact that the at least one inhalation opening is formed on the housing, the inhalation opening is located in the direct vicinity of the mouthpiece, so that the inhalation channel is very short. Therefore, there is no enlargement or only a negligible enlargement of the dead space, since the breathing air is drawn in in the direct proximity of the mouthpiece. The inhalation opening is exposed, in particular, i.e., it is not connected to further elements, for example, a tube. The suctioning in of the fresh air as well as the separation of the inhaled air and the exhaled air therefore takes place in one component. Preferably, the housing is formed as at least two pieces, in particular comprising an upper shell and a lower shell, whereby the assembly and manufacture of the breathing aid is facilitated.

The at least one inhalation opening is situated on the same side of the housing, in particular on the underside of the housing, as the mouthpiece. Preferably, multiple inhalation openings are provided, so that a sufficient amount of breathing air is available to a user. The inhalation openings and the mouthpiece can be situated on the same side. As a result, the mouthpiece and the inhalation openings can be situated so as to be more easily covered, in order to prevent penetration, for example, of snow. In particular, the complete surface of the underside of the housing can be designed as an air inlet (except in an area in which the exhalation channel is situated).

It is particularly advantageous when a closed cover is provided for covering the mouthpiece and/or the at least one inhalation opening. Therefore, penetration of snow or moisture can be prevented when the breathing aid is not needed. Therefore, neither the mouthpiece nor the inhalation openings can clog or ice up. The functional capability in the case of emergency, i.e., upon the occurrence of an avalanche, can therefore be ensured.

The housing can be detachably connectable to the cover. Therefore, the cover can be removed particularly easily and quickly from the housing when the breathing aid is to be utilized. The advantage of the cover is, in particular, that the open mouthpiece and, therefore, the sensitive inner workings of the handle are first "opened" in the instant of the triggering. This has the advantage that no foreign objects can enter the handle or ice up the valves through the mouthpiece when it is not detached. The handle is ready for breathing only when the handle is actually used/by being pulled away from the cover (in the instant that the avalanche starts).

In particular, the cover can comprise a receptacle for the mouthpiece. The breathing aid can therefore be inserted, together with the mouthpiece, into the receptacle and can be easily detached from the cover once again.

The mouthpiece can be clippable into the cover. As a result, it is particularly easy to separate the mouthpiece from the cover once again. Therefore, the breathing aid is particularly quickly operational. The cover can consist of different parts comprising different materials. For example, a fastening part can be made of a harder material and, for example, connected to a carrying system, while a softer part can be resilient, so that the mouthpiece can be easily clipped in and removed once again in the area of the soft part.

Alternatively or additionally, it can be provided that a projection is provided on the cover, which can be inserted into a corresponding inner contour of the mouthpiece, or the inner contour of the mouthpiece can be slipped over the projection and clipped to the projection. In particular due to this measure, it is possible to provide the cover without a rim, i.e., the cover can be designed without a rim that encircles the mouthpiece. The contour of the mouthpiece is therefore larger than the contour of the cover plate, and so steps or gaps are avoided, in which water can settle. It is therefore possible to prevent the mouthpiece from freezing on the cover plate. In addition, the inner contour is sealed.

The cover can comprise a fastening means for fastening to a carrying system, in particular, a shoulder strap. Therefore, the breathing aid can be fastened, for example, to a shoulder strap via the cover. The receptacle can be open toward the bottom, so that, in the case of emergency, the user can pull the housing downward out of the receptacle and thereby trigger the avalanche rescue system. Simultaneously, the user can bring the breathing aid to the mouth.

The fastening means can be designed, for example, in such a way that the cover can be fastened to the shoulder strap in different positions. For example, a piping system can be provided, so that the receptacle can be steplessly adjusted on the shoulder strap.

Moreover, the fastening means can comprise, for example, four projections. In particular, the fastening means can be designed to be cross-like, so that the fastening means can be fastened in positions offset by 90 degrees on appropriate tabs of a shoulder strap. In particular, it is possible, as a result, to fasten the cover to the left and the right shoulder straps in positions offset by 90 degrees. This can be advantageous, in particular, in order to effectuate an alignment of the breathing aid or the housing, so that the housing can be gripped particularly well and the mouthpiece can be brought to the mouth without a further rotary motion.

Further advantages of the invention result when a filter element is situated in the inhalation channel and/or in the area of the at least one inhalation opening. Therefore, particles, water, or snow can be prevented from entering the valves and clogging them or icing them up.

Particular advantages result when the filter element is made of hydrophobic material. Moreover, the filter element can rest against the wall of the inhalation channel. Therefore, in particular, there is no intermediate space between the filter element and the wall of the inhalation channel, so that no water can collect there.

The filter element can be formed from an air-permeable and water-repellent material. In particular, the material may have been rendered hydrophobic and/or may be plasma-treated, in order to design the material to be water-repellent. The filter element can be designed as a textile, in particular, cloth, woven fabric, knitted fabric, fleece, or the like. The filter element can be flexible. The filter element is preferably fixed in the area of an inhalation opening. The cloth can be clamped between the upper shell and the lower shell of the housing. The filter element can be situated in a planar manner with respect to the outer side of the housing. Therefore, steps or gaps can be avoided, at which ice, snow, or water deposits can form.

In order to prevent water from entering the area of the inhalation opening and, in particular, the area of the filter element, one or multiple water deflectors, in particular, lamellae, can be provided in the area of the inhalation opening. The lamellae can be aligned and situated with respect to one another in such a way that, in the event that water impacts the housing perpendicularly to the surface, no water can enter the filter element. For example, the lamellae can be aligned in an angular range between 30 degrees and 60 degrees with respect to the surface of the housing.

The exhalation channel can be connected to an air conduit, in particular, a tube. Therefore, the exhalation air can be conveyed away from the mouthpiece and discharged at another point. Therefore, the situation in which exhaled $CO_2$ is inhaled once again can be effectively prevented.

As mentioned above, the housing can be connected to a triggering mechanism of an avalanche rescue system. Therefore, as the breathing aid is being brought to a user's mouth, the triggering mechanism can be triggered and, for example, activate an avalanche airbag.

The triggering mechanism or a part of the triggering mechanism can be coupleable to the housing at different points. Therefore, the breathing aid can be utilized on the left as well as on the right, i.e., on a left or a right shoulder strap and can be detached by a user using the left hand or the right hand. In particular, it can be provided that the triggering mechanism can be coupled or fastened to the housing on the right or the left. For this purpose, appropriate recesses, for example, can be provided on the housing, into which a thickened end piece of a cable pull can be inserted. The thickened end of the cable pull can then be secured in the recess, for example, via a type of bayonet mount. The bayonet mount, in turn, can be secured, in order to prevent an inadvertent opening. The securing can take place via a blockage of the space in which the bayonet base moves.

The valves in the housing can be designed, for example, as drain valves. The valves are situated within the housing and separate the inhalation air from the exhalation air. The exhalation air can be conveyed, via an exhalation tube which extends across a shoulder strap of a carrying system, onto the back side of a backpack situated on the carrying system, and can be discharged there. Since the area at which the fresh air is drawn in is situated at a different location than the exhalation area, the situation in which exhaled $CO_2$ is inhaled once again can be effectively prevented. A considerably longer survival time under an avalanche is the result.

The inhalation air can be filtered through a hydrophobic filter. This has the advantage that no particles, water, or snow can enter the valve system. Water in the valve system could cause the valves to freeze. The inhalation openings are protected by the hydrophobic but air-permeable filter.

The inhalation opening and the mouthpiece are first opened when the housing is detached from the receptacle, in particular, a locking plate. As a result, it is ensured that no moisture, water, snow, or other particles can therefore enter the filter and/or the valves through the mouthpiece. The filter can be planar with respect to the upper half of the housing or the outer side of the housing. As a result, no water can accumulate and result in the inhalation opening freezing and clogging. The hydrophobic material of the filter element, together with the cover, forms a closed system into which neither condensed water nor moisture can penetrate.

The mouthpiece on the housing back side can be detachably connected to the shoulder strap of a carrying system, in particular, a backpack, via the cover, in particular, a locking plate. Due to the shape of the cover, the mouthpiece can be hidden and protected from external influences. Moreover, due to the placement of the mouthpiece on the underside of the housing or the handle-like housing, as well as the shape of the housing, a lever effect caused by the snow masses of the avalanche is reduced by the greatest extent possible. An opening of the cover toward the bottom permits the triggering of an airbag system as well as the detachment of the breathing aid from the cover by pulling downward on the breathing aid. Moreover, the locking plate offers the advantage that the handle and the breathing system can be utilized without the airbag system. The mouthpiece/the handle can therefore be locked on the shoulder strap without a triggering mechanism of the airbag system.

Due to the arrangement of the two valves in the housing, the inhalation air is separated from the exhalation air at the first possible point. As a result, in contrast to the prior art, no $CO_2$ is inhaled once again. A dead space is dispensed with. Due to the fact that known systems do not separate the breathing air from the exhalation air directly in front of the mouth, valves are not actuated in the case of shallow breathing, which can have the result that the exhalation air is not separated from the inhalation air.

The system according to the invention also requires only one tube which is utilized for discharging the exhalation air. A tube from the inhalation channel to a valve unit which is situated, for example, on a user's shoulder, is dispensed with.

Due to the fact that the inhalation openings are situated on the underside of the housing, the inhalation openings are not covered by a user's hand when the hand brings the breathing aid to the mouth. Therefore, it is advantageous when the inhalation openings are situated in the area of the mouthpiece, in particular, on the same side of the housing as the mouthpiece.

The mouthpiece can be situated on the housing so as to be rotatable through 360 degrees and lockable in 90-degree positions. It can be provided that the mouthpiece can be latched in the two end positions of the swivel range, so that the position of the mouthpiece is fixed relative to the housing. Therefore, the mouthpiece can be aligned in different positions with respect to the housing, whereby the breathing aid can be adapted for use or fastening on the left or the right shoulder strap of a carrying system. In particular, it can be provided that the mouthpiece can be swiveled through 45 degrees in the clockwise or counterclockwise direction relative to a longitudinal axis of the housing. Therefore, the breathing aid can be fastened on the shoulder strap in such a way that the user, in one simple movement, can detach the housing, including the mouthpiece, from the shoulder strap and bring it to his or her mouth, without the need to adapt the housing and, therefore, the mouthpiece, to the position of his or her mouth with the aid of a rotary motion.

The fastening of the air conduit on the housing can be easily brought about by way of the fact that a counter bearing is provided in the air conduit, so that the air conduit can be clamped between the counter bearing and the housing. Therefore, clamps or cable ties for fastening the air conduit on the housing can be avoided. As a result, and due to the movable mouthpiece, the handle can be moved in all spatial axes, so that the handle can move along with the snow pack and is flexible. As a result, the handle can be held in the mouth even in the presence of strong forces caused by the snow pack.

Further features and advantages of the invention result from the detailed description of exemplary embodiments of the invention that follows, with reference to the figures in the drawing which shows the details that are essential to the present invention. Further features and advantages of the present invention also result from the claims. The features described therein are not intended to be interpreted literally, and are presented in such a manner that the special features of the present invention may be presented clearly. The various features can be implemented individually, or these can be combined in any possible manner in different variants of the invention.

BRIEF DESCRIPTION OF THE DRAWING FIGURES

DETAILED DESCRIPTION OF THE INVENTION

Figure 1:
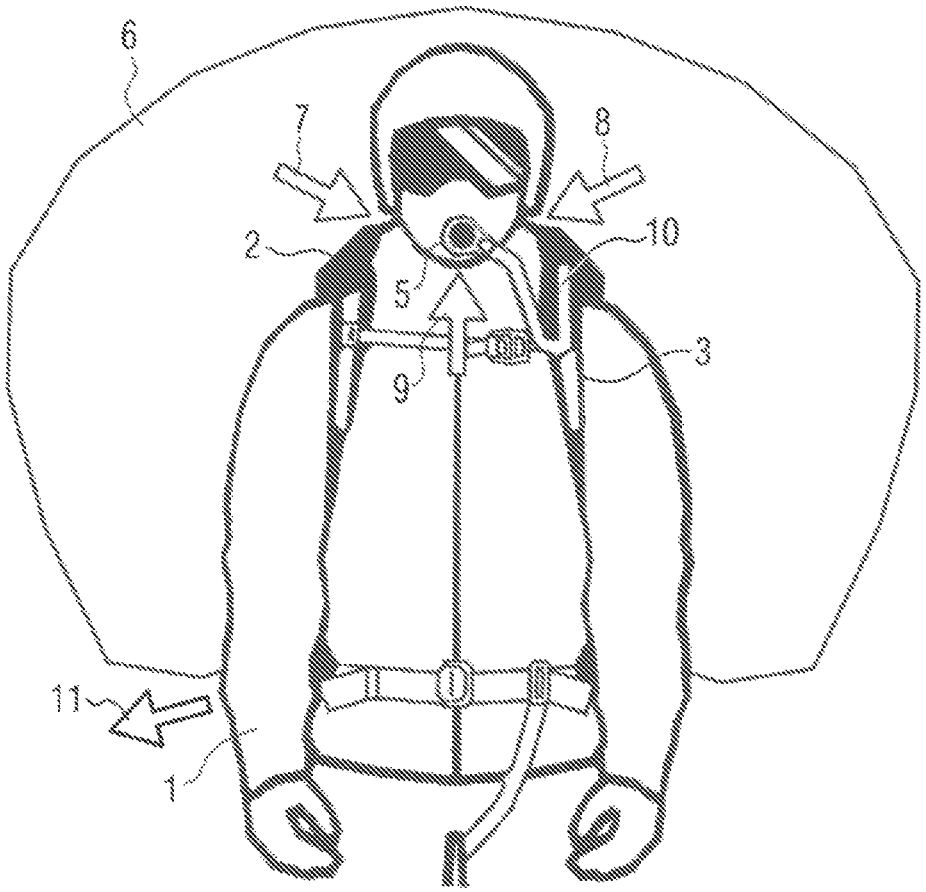
FIG. 1 shows a user with a triggered avalanche airbag and the breathing aid in the area of a user's mouth.

FIG. 1 shows a user 1 carrying an avalanche rescue system comprising a carrying system 2 which includes shoulder straps 3. A handle-like breathing aid 5 has been detached from a holder on the shoulder strap 3 and brought to the mouth. In so doing, a triggering mechanism was actuated, so that an avalanche airbag 6 was inflated. Air in the direct proximity of the breathing aid 5 is inhaled through the breathing aid 5, as indicated by the arrows 7, 8, and 9. Exhaled air is conveyed via the tube 10 along the shoulder strap 3 and into the avalanche rescue system, in particular, a backpack, so that the exhaled air can be discharged at the lower end of the avalanche rescue system, which is indicated by the arrow 11. The tube 10 does not extend in the hollow space/pack area of a backpack, but rather in the "rear wall" of the backpack and, therefore, does not come into contact with the interior space/pack area of the backpack.

Figure 2:
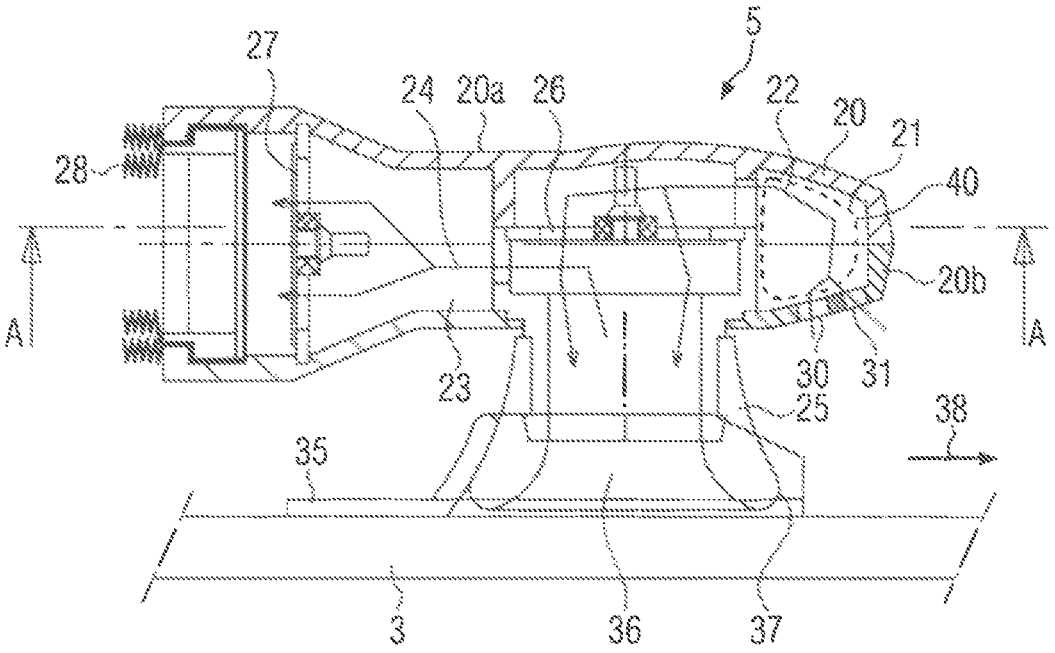
FIG. 2 shows a partial longitudinal sectional representation of a breathing aid.

FIG. 2 shows a partial sectional representation of a breathing aid 5. The breathing aid 5 comprises a housing 20 including an upper housing half 20*a* and a lower housing half 20*b*. An inhalation channel 21 is formed in the housing 20, wherein the path of the inhalation air is marked by the reference numeral 22. Moreover, an exhalation channel 23 is formed in the housing 20, wherein the path of the exhalation air is marked by the reference numeral 24. Both the inhalation channel 21 and the exhalation channel 23 open into a mouthpiece 25. A valve 26 is situated in the inhalation channel 21. The valve 26 is designed as a drain valve and automatically opens upon inhalation and automatically closes upon exhalation.

A valve 27, which is designed as a drain valve, is also situated in the exhalation channel 23. The valve 27 automatically closes upon inhalation and automatically opens upon exhalation. Abutting the exhalation channel 23 is an air conduit 28, in particular, the tube 10 (FIG. 10) for discharging exhaled air. An annular counter bearing 29 is situated in the air conduit 28, wherein the air conduit 28 is clamped between the counter bearing 29 and the housing 20.

The inhalation channel 21 opens into inhalation openings 30, 31. The inhalation openings 30, 31 are exposed and are situated on the same side of the housing 20 as the mouthpiece 25. In particular, the inhalation openings 30, 31 are situated on an underside or back side of the housing 20. A user can therefore grip the upper side or the upper housing half 20*a* without having to be afraid of covering the inhalation openings 30, 31. Therefore, a user can bring the breathing aid 5 to the mouth and, if necessary, hold the breathing aid 5 on the mouth, without covering the inhalation openings 30, 31.

A cover 35 is fastened to the carrying system 2, in particular, on the shoulder strap 3. The breathing aid 5 is held on the shoulder strap 3 via the cover 35. The cover 35 is formed as a type of slot in the area 36, in particular being open at the point 37. The breathing aid 5 can therefore be removed from the cover 35 in the arrow direction 38, whereby the mouthpiece 25 is exposed. In the position shown, the mouthpiece 25 is covered by the cover 35, so that no particles, snow, or moisture can enter the housing 20 via the mouthpiece. The mouthpiece 25 can be latched in the cover 35.

According to an embodiment which is not shown, the cover 35 can be designed in such a way that the inhalation openings 30, 31 can also be covered, so that no moisture can enter here, either.

A filter element 40, which is made, in particular, of hydrophobic material, is situated in the inhalation channel 21. The filter element 40 prevents snow, moisture, or particles from entering the housing 20 via the inhalation openings 30, 31 and prevents the inhalation channel 21 from becoming clogged, in particular preventing moisture from entering up to the valve 26 or even the valve 27. Therefore, an impairment of the function of the valves 26, 27, in particular due to freezing up, can be prevented.

Figure 3:
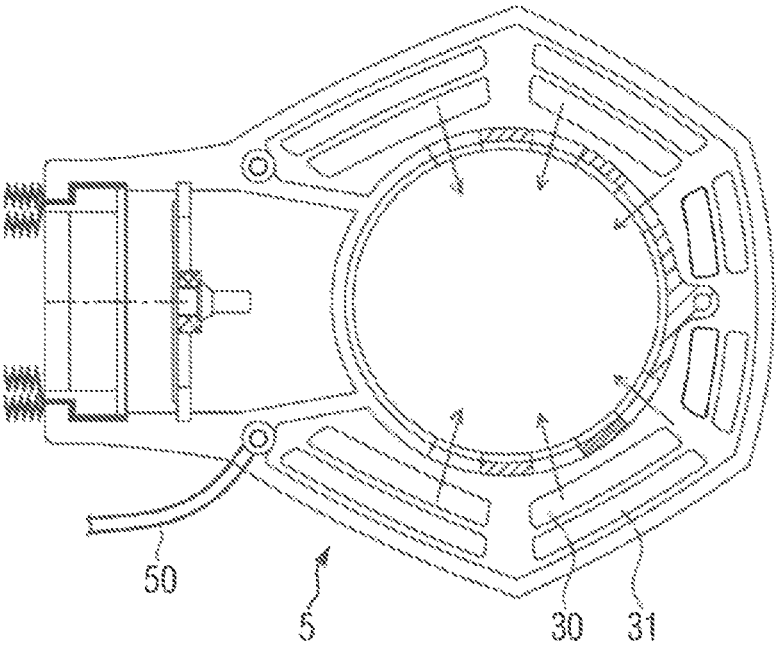
FIG. 3 shows a partial sectional representation according to the line A-A from FIG. 2.

It is clear from the representation in FIG. 3 that inhalation openings 30, 31 are situated so as to be distributed essentially across the entire underside of the housing 20, thereby creating an inhalation surface which is as large as possible. Moreover, it is clear from FIG. 3 that a part 50 of a triggering mechanism for the avalanche rescue system is situated on the breathing aid 5. Therefore, by pulling on the breathing aid 5, in particular when the breathing aid 5 is detached from the cover 35 in the arrow direction 38, an avalanche rescue system, in particular, an avalanche airbag, can be simultaneously triggered. Therefore, multiple functions are combined on the breathing aid 5. The mouthpiece 25 can be made of soft and resilient material, in order to improve a user's comfort. In addition, the diaphragms of the valves 26, 27 can be made of silicone.

Figure 4:
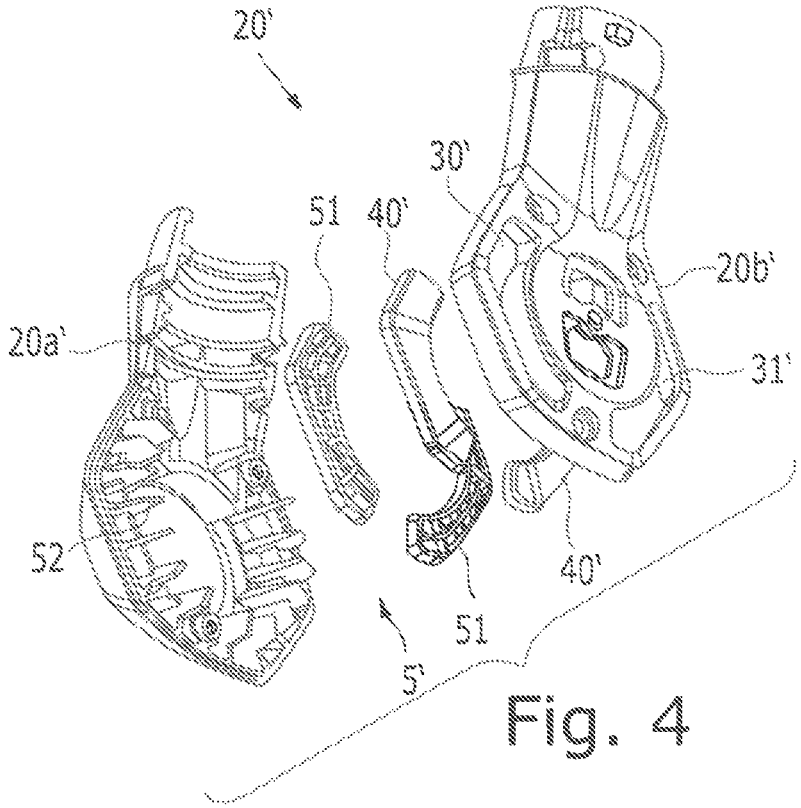
FIG. 4 shows an exploded representation of an alternative embodiment of a breathing aid.

FIG. 4 shows an exploded representation of an alternative embodiment of a breathing aid 5'. The breathing aid 5' also comprises an upper housing half 20*a'* and a lower housing half 20*b'*. The lower housing half 20*b'* comprises inhalation openings 30', 31'. Filter elements 40', which can be formed from textile material, in particular, cloth, are provided in the area of the inhalation openings 30', 31'. The filter elements 40' are supported by support structures 51 in the area of the inhalation openings 30', 31'. The support structures 51 can be designed to be grid-like. The support structures 51 can clamp the filter elements 40' in an edge area of the inhalation openings 30', 31', so that the filter elements 40' are always taut. In particular, the support structures 51 can be proportioned in such a way that they position the filter elements 40' in the area of the inhalation openings 30', 31' in such a way that the inhalation openings 30', 31' are planar with a surface of the housing 20', in particular, the lower housing half 20*b'*.

Support elements 52, against which the support structures 51 can abut, can be provided in the upper housing half 20*a*'. By joining the housing halves 20*a*', 20*b*', the support structures 51 and the filter elements 40' are therefore clamped between the housing halves 20*a*', 20*b*' and, therefore, are fixedly positioned.

Figure 5:
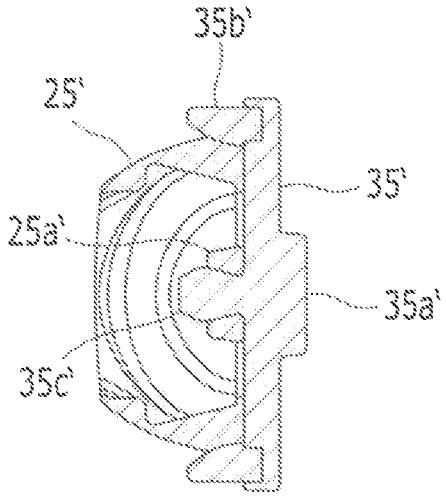
FIG. 5 shows a sectional representation through a mouthpiece and a cover.

FIG. 5 shows a sectional representation through a mouthpiece 25' and a cover 35'. The cover 35' comprises a part 35*a*' made of a harder material and a part 35*b*' made of a comparatively softer material. The softer material 35*b*' can move out of the way of the mouthpiece 25' when the mouthpiece 25' is brought together with the cover 35'. Therefore, the mouthpiece 25' can be clipped to the cover 35'. In addition, the cover 35' can comprise a projection 35*c*' which has a thickened portion and engages through an element 25*a*' of the mouthpiece 25' having an expandable opening. Therefore, the mouthpiece 25' is also detachably held on the cover 35' via the projection 35*c*'.

Figure 6:
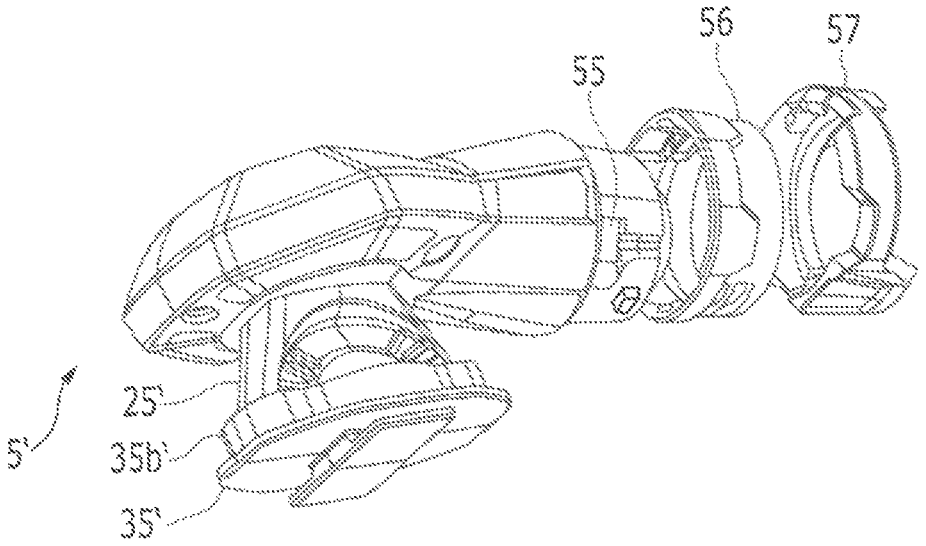
FIG. 6 shows a perspective representation of the alternative embodiment of the breathing aid.

FIG. 6 shows a perspective representation of the breathing aid 5'. The cover 35' is connected to the mouthpiece 25'.

Moreover, it is apparent from FIG. 6 that the breathing aid 5' comprises a coupling point 55 for coupling to a part of a triggering mechanism. The coupling point 55 can be designed as a recess. Such a coupling point 55 can also be provided on the opposite side of the breathing aid 5', which is not visible here. A thickened end of a triggering mechanism can be placed into the recess of the coupling point 55 and fixed there with the aid of a fixing element 56. The fixing element 56 can be designed as a bayonet mount. A securing element 57 can be provided, in turn, for securing the fixing element 56. The securing element 57 can prevent the fixing element 56 from inadvertently detaching, in particular, inadvertently rotated back and exposing the part of the triggering mechanism.

On the other hand, the fixing element 56 can be intentionally detached in order to decouple the triggering mechanism on the one side of the breathing aid 5' and to couple the triggering mechanism on the opposite side of the breathing aid 5'. This can be helpful, in particular, when the breathing aid 5' is to be moved from the left shoulder strap to the right shoulder strap, or vice versa.

Figure 7:
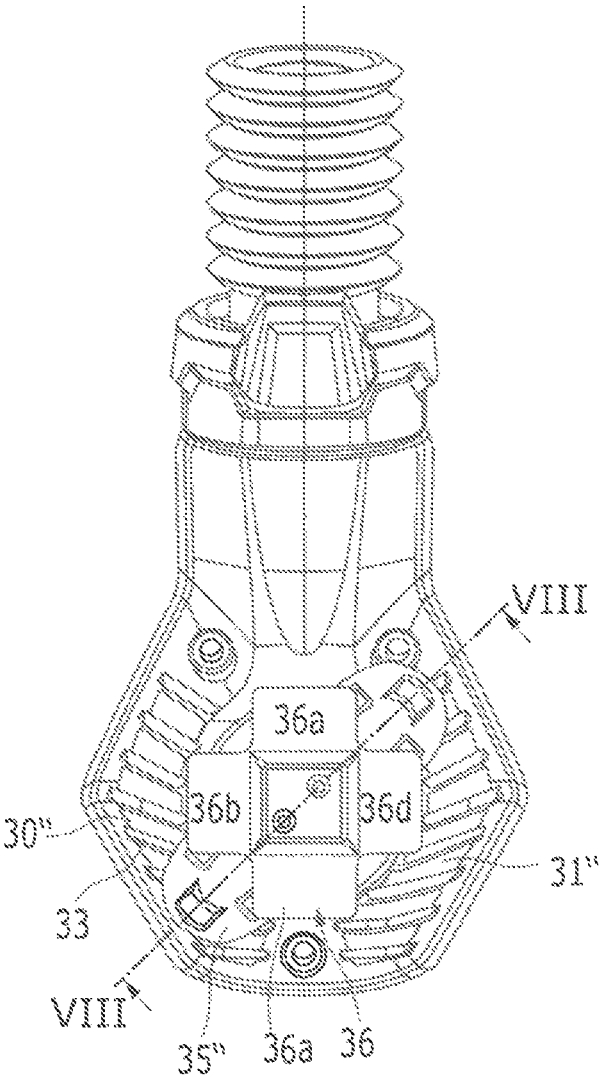
FIG. 7 shows a view from below onto an embodiment of a breathing aid.

It is apparent from FIG. 7, on the one hand, that water deflectors 33 designed as lamellae are provided in the area of the inhalation openings 30" and 31", which reduce the water pressure and prevent water from entering the area of the filter element and, therefore, prevent the filter element from icing up. In addition, the lamellae allow for larger breathing openings in the filter element.

Moreover, it is apparent from FIG. 7 that a fastening means 36 is provided on the cover 35" for fastening to a shoulder strap. The fastening means 36 is designed to be cross-like and comprises projections 36*a*-36*d*.

Therefore, the fastening means 36 comprising the opposing projections 36*a*, 36*c* or 36*b*, 36*d* can be fastened to adjacent loops provided on a shoulder strap. The cover 36 can therefore be fastened to a shoulder strap in positions offset by 90 degrees.

Figure 8:
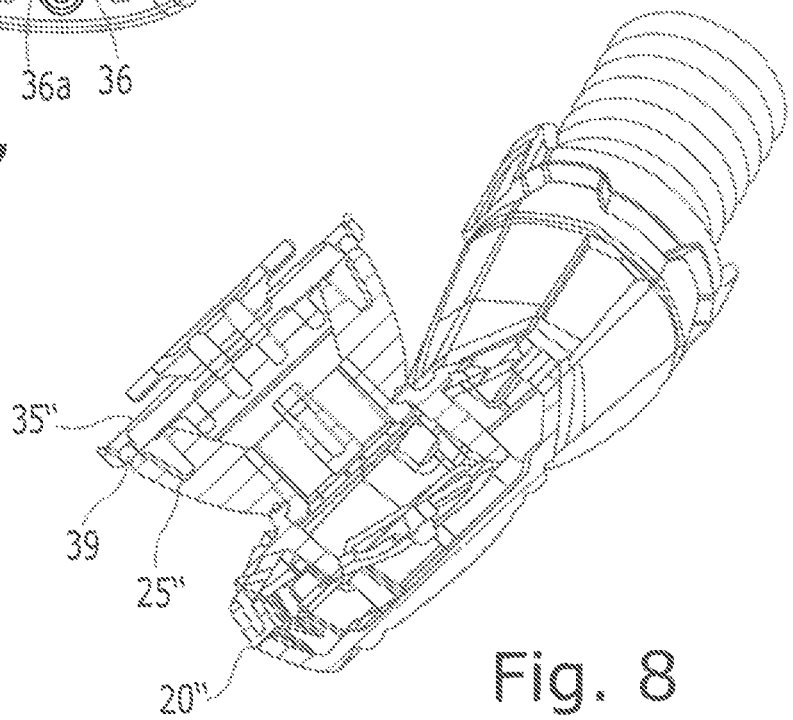
FIG. 8 shows a sectional representation according to the line VIII-VIII from FIG. 7.

It is apparent from the sectional representation from FIG. 8 that the cover 35" does not circumferentially enclose the mouthpiece 25" and does not comprise a rim suitable therefor. The mouthpiece 25" can be sealed with respect to the cover 35", for example, via a seal 39. The mouthpiece 25" can be swivelable with respect to the housing 20". In particular, the mouthpiece 25" can be swivelable between two end positions offset by 90 degrees, wherein the mouthpiece 25" can be latched in the end positions. Therefore, the mouthpiece 25" can be adapted to different fastening positions of the cover 35".

What is claimed is:

1. A breathing aid (5, 5') is configured for enabling a person buried by an avalanche to breathe, comprising a housing (20) which includes an inhalation channel (21) comprising a valve (26) situated in the housing (20), which automatically opens during inhalation and automatically closes during exhalation, and an exhalation channel (23) comprising a valve (27) situated in the housing (20, 20', 20"), which automatically closes during inhalation and automatically opens during exhalation, wherein the inhalation channel (21) and the exhalation channel (23) open into a mouthpiece (25, 25') situated on the housing (20, 20', 20"), and the housing (20, 20', 20") includes at least one inhalation opening (30, 31, 30', 31', 30", 31") into which the inhalation channel (21) opens, wherein the housing (20, 20') is designed as a handle which is configured to be gripped by a user's hand and brought to the mouth, wherein the at least one inhalation opening (30, 31, 30', 31') and the mouthpiece (25, 25', 25") are situated on an inner side of the housing (20, 20', 20"), wherein the inner side is positioned in front of a face of the user when the breathing appliance is worn by the user, and the at least one inhalation opening is formed on an exterior surface of the housing (20, 20', 20") on the inner side and is exposed to an exterior of the breathing aid on the inner side.

2. The breathing aid as claimed in claim 1, wherein a closed cover (35, 35', 35") is provided for covering the mouthpiece (25, 25', 25") and/or the at least one inhalation opening (30, 31, 30', 31', 30", 31").

3. The breathing aid as claimed in claim 2, wherein the housing (20, 20', 20") is detachably connectable to the cover (35, 35', 35").

4. The breathing aid as claimed in claim 2, wherein the cover (35) comprises a receptacle for the mouthpiece (25).

5. The breathing aid as claimed in claim 2, wherein the mouthpiece (25', 25") is configured to be clipped into the cover (35', 35").

6. The breathing aid as claimed in claim 2, a shoulder strap (3) of a carrying system (2).

7. The breathing aid as claimed in claim 2, wherein the cover (35"") does not comprise a rim encircling the mouthpiece (25).

8. The breathing aid as claimed in claim 1, wherein a filter element (40, 40') is situated in the inhalation channel (21) and/or in an area of the at least one inhalation opening (30, 31, 30', 31', 30", 31").

9. The breathing aid as claimed in claim 8, wherein the filter element (40) is made of hydrophobic material.

10. The breathing aid as claimed in claim 8, wherein the filter element (40') is made of an air-permeable and water-repellent material.

11. The breathing aid as claimed in claim 8, wherein the filter element (40, 40') rests against an entire surface of the wall of the inhalation channel (21) and/or is situated so as to be planar with respect to an outer side of the housing (20, 20', 20").

12. The breathing aid as claimed in claim 8, wherein one or more water deflectors (33) are situated in the area of the inhalation opening (30", 31"), wherein the filter element (40, 40') is situated beneath the one or more water deflectors (33).

13. The breathing aid as claimed in claim 1, wherein the exhalation channel (23) is connected to an air conduit (28).

14. The breathing aid as claimed in claim 13, wherein a counter bearing (29) is situated in an interior of the air conduit (28) in an area of the housing (20, 20', 20"), so that the air conduit is clamped between the counter bearing (29) and the housing (20, 20', 20").

15. The breathing aid as claimed in claim 1, wherein the housing (20, 20', 20") is connected to a triggering mechanism (50) of an avalanche rescue system.

16. The breathing aid as claimed in claim 15, wherein the triggering mechanism (50) is configured to be coupled to the housing (20', 20") at different points.

17. The breathing aid as claimed in claim 1, wherein the mouthpiece (25") is situated so as to be rotatable through 360 degrees and lockable on the housing (20") in 90-degree positions.

* * * * *